US009222235B2

(12) United States Patent
Frey

(10) Patent No.: US 9,222,235 B2
(45) Date of Patent: Dec. 29, 2015

(54) COUPLER-ASSEMBLY FOR ATTACHING BUCKET OR THE LIKE TO ARTICULATING ARM

(71) Applicant: Steven Oscar Frey, Elmira (CA)

(72) Inventor: Steven Oscar Frey, Elmira (CA)

(73) Assignee: AMI Attachments Inc., Elmira, Ontario (CA)

( * ) Notice: Subject to any disclaimer, the term of this patent is extended or adjusted under 35 U.S.C. 154(b) by 322 days.

(21) Appl. No.: 13/873,618

(22) Filed: Apr. 30, 2013

(65) Prior Publication Data

US 2014/0321956 A1 Oct. 30, 2014

(51) Int. Cl.
*E02F 3/36* (2006.01)
*E02F 9/22* (2006.01)

(52) U.S. Cl.
CPC ..... *E02F 3/3663* (2013.01); *E02F 3/364* (2013.01); *E02F 3/365* (2013.01); *E02F 3/3631* (2013.01); *E02F 9/2267* (2013.01); *E02F 9/2271* (2013.01); *E02F 9/2275* (2013.01)

(58) Field of Classification Search
CPC ..... E02F 3/3663; E02F 3/364; E02F 3/365; E02F 3/3631; E02F 9/2267; E02F 9/2275; E02F 9/2271
USPC ..... 414/723; 37/468
See application file for complete search history.

(56) References Cited

U.S. PATENT DOCUMENTS

| | | | | |
|---|---|---|---|---|
| 5,634,736 | A * | 6/1997 | Brown et al. | 403/322.4 |
| 6,305,106 | B1 * | 10/2001 | McLellan | 37/468 |
| 7,654,019 | B2 * | 2/2010 | Yeager et al. | 37/468 |
| 7,654,787 | B2 * | 2/2010 | Sonerud | 414/723 |
| 7,882,898 | B1 * | 2/2011 | Vering et al. | 172/272 |
| 8,602,676 | B2 * | 12/2013 | Stollery | 403/322.1 |
| 2003/0231946 | A1 * | 12/2003 | Heiple | 414/723 |

FOREIGN PATENT DOCUMENTS

EP 0058058 A2 * 8/1982

* cited by examiner

*Primary Examiner* — Dean Kramer
(74) *Attorney, Agent, or Firm* — Anthony Asquith Corp.

(57) ABSTRACT

For use with a front-end loader etc, the coupler-assembly provides a rigid connection between the pivoting arm-end and the bucket. Included is a slider-block, guided in slide-guides and slider-slots in side-plates of the frame of the arm-end. Sliding the block using a hydraulic slider ram, wedges the bucket lugs tightly into the frame. The slider-ram is integrated into and moves with the block. A lock-spring urges a lock-bolt into position to lock the bucket-lug to the arm-end frame. A lock-ram releases the lock-bolt, to permit disengagement.

13 Claims, 12 Drawing Sheets

A
67
52
70
61
43
B
67
36
61
32
34
54
C
67
52
34

COUPLER-ASSEMBLY FOR ATTACHING BUCKET OR THE LIKE TO ARTICULATING ARM

DESCRIPTION

This technology relates to front-end loaders, or the like, being vehicles equipped with a movable articulating mast or arm, to which a bucket can be attached, and relates especially to a coupling-assembly for incorporation into, and for use with, such vehicles.

LIST OF DRAWINGS

Figure 1:
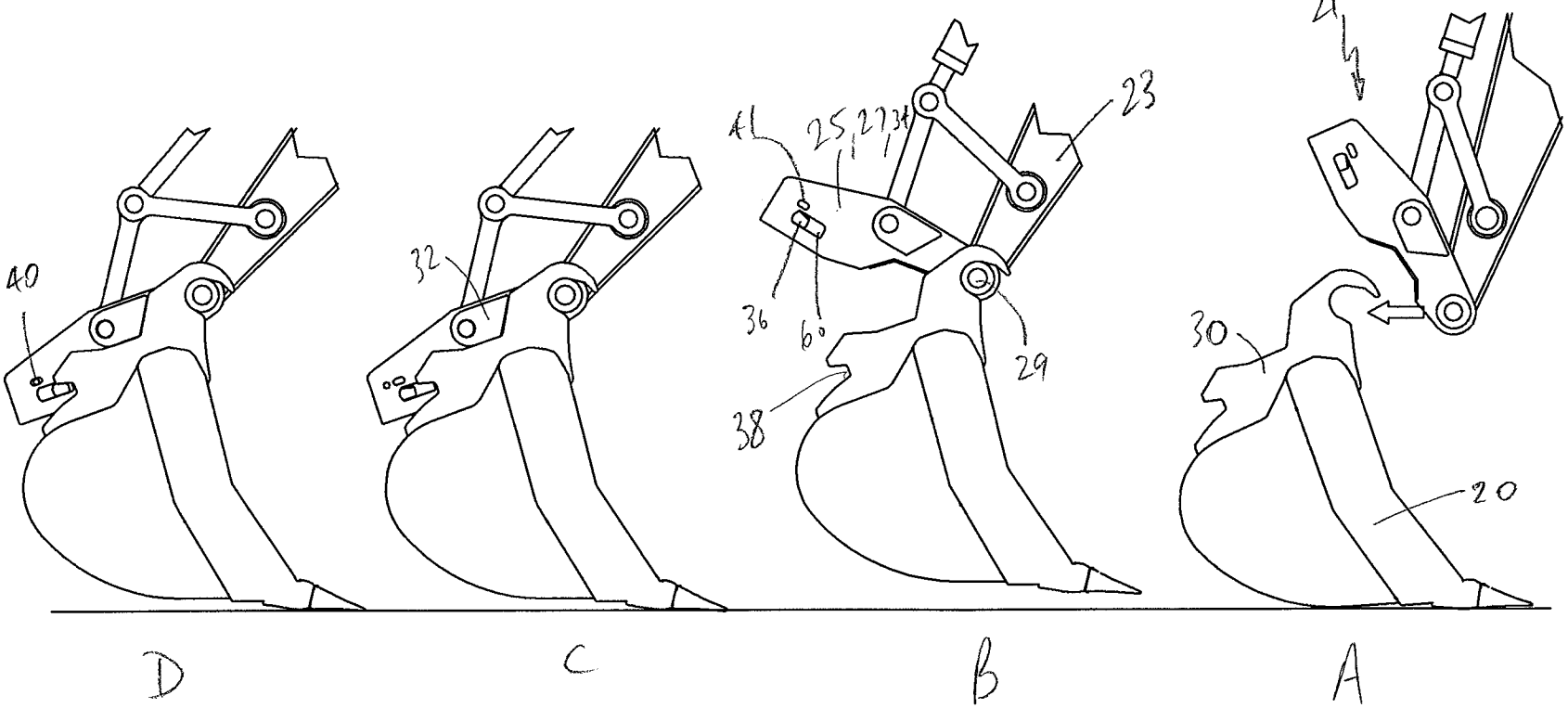
FIGS. 1A, 1B, 1C, 1D are side elevations of the articulable arm of a front-end-loader being operated to pick a bucket from the ground, shown in four stages.

FIG. 1A shows a bucket 20 resting on the ground, and about to be picked up by a coupler-assembly 21 mounted on the articulating mast or arm 23 of a front-end-loader. The coupler-assembly 21 includes an arm-end 25, the frame 27 of which is pivoted to the arm 23 at an arm-end pivot-pin 29. In FIG. 1A, the driver of the front-end-loader has manipulated the arm 23, and the arm-end 25, in such manner that the coupler-assembly 21 is about to snag the bucket-lugs 30 which are integrated into the bucket 20.

In FIG. 1B, the bucket-lugs 30 have been hooked onto the pivot-pin 29. However, the bucket 20 is not at all securely attached to the arm 23 at this stage. In FIG. 1C, the driver has rotated the arm-end 25 about the pivot-pin 29 such that the bucket-lug 30 lies snugly nestled between the pivot-pin 29 and a cheek-piece 32, which is integrated into a side-plate 34 of the arm-end frame 27. However, securement of the bucket 20 to the arm 23 is still not complete.

In FIG. 1D, a tenon 36 of the coupler-assembly 21 has been advanced, and has now engaged a mortise 38, formed in the bucket-lug 30. Hydraulic pressure is maintained, in the coupler-assembly, at all times while the bucket is in operation. The coupler-assembly includes a lock-bolt 40, which enters a lock-slot 41 in the side-plate of the frame 27. If the hydraulic pressure were to fail, for example, the presence of the lock-bolt 40 in the lock-slot 41 would ensure that the bucket 20 cannot fall off the arm 23.

Figure 2:
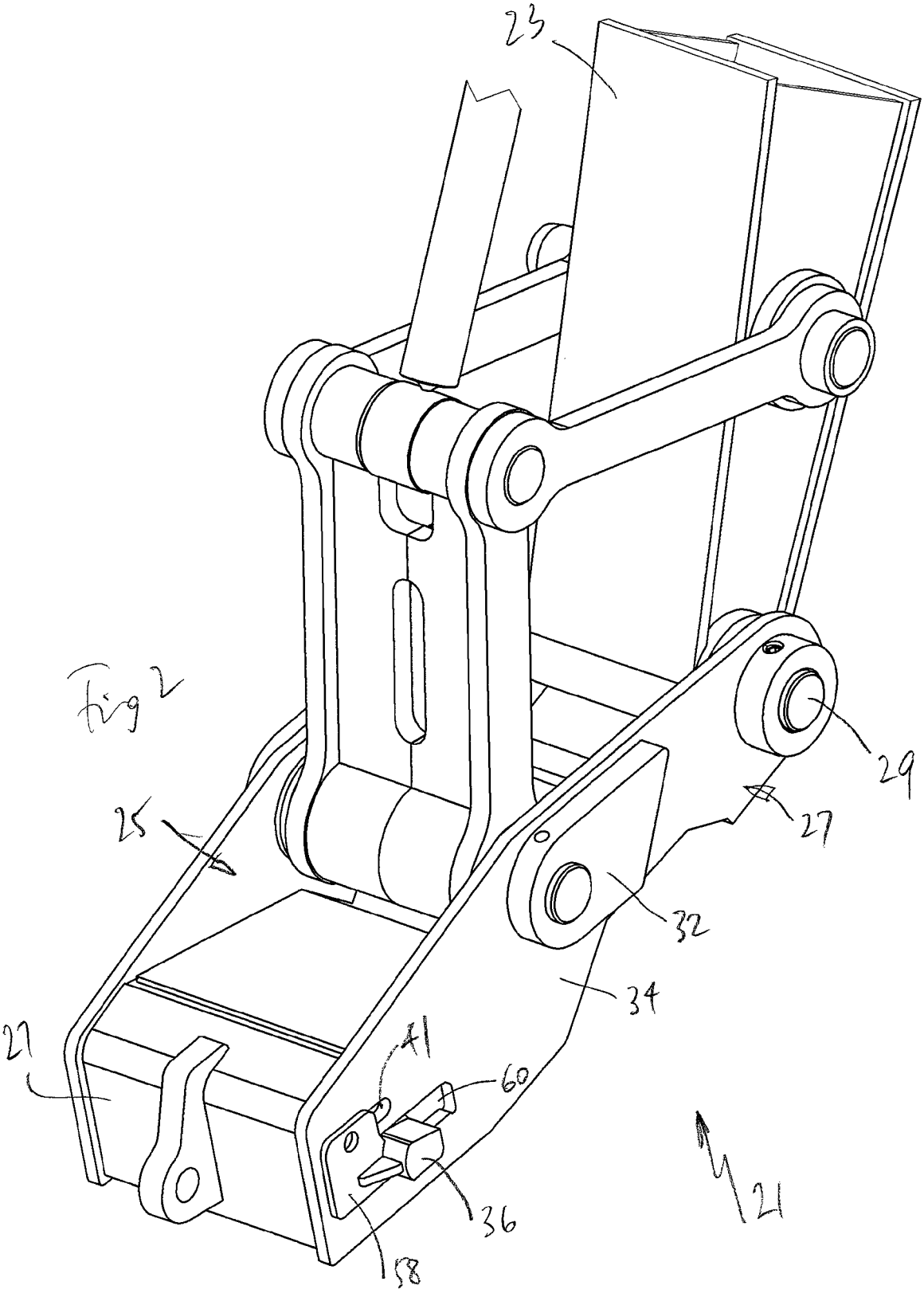
FIG. 2 is a pictorial view of a coupler-assembly of FIG. 1, carried on the distal end of the arm.

FIG. 2 shows the arm-end 25 of the coupler-assembly 21 mounted to arm 23. No bucket is attached, in FIG. 2, and the tenon 36 is in its withdrawn-position as shown in FIGS. 1A, 1B, 1C.

Figure 3:
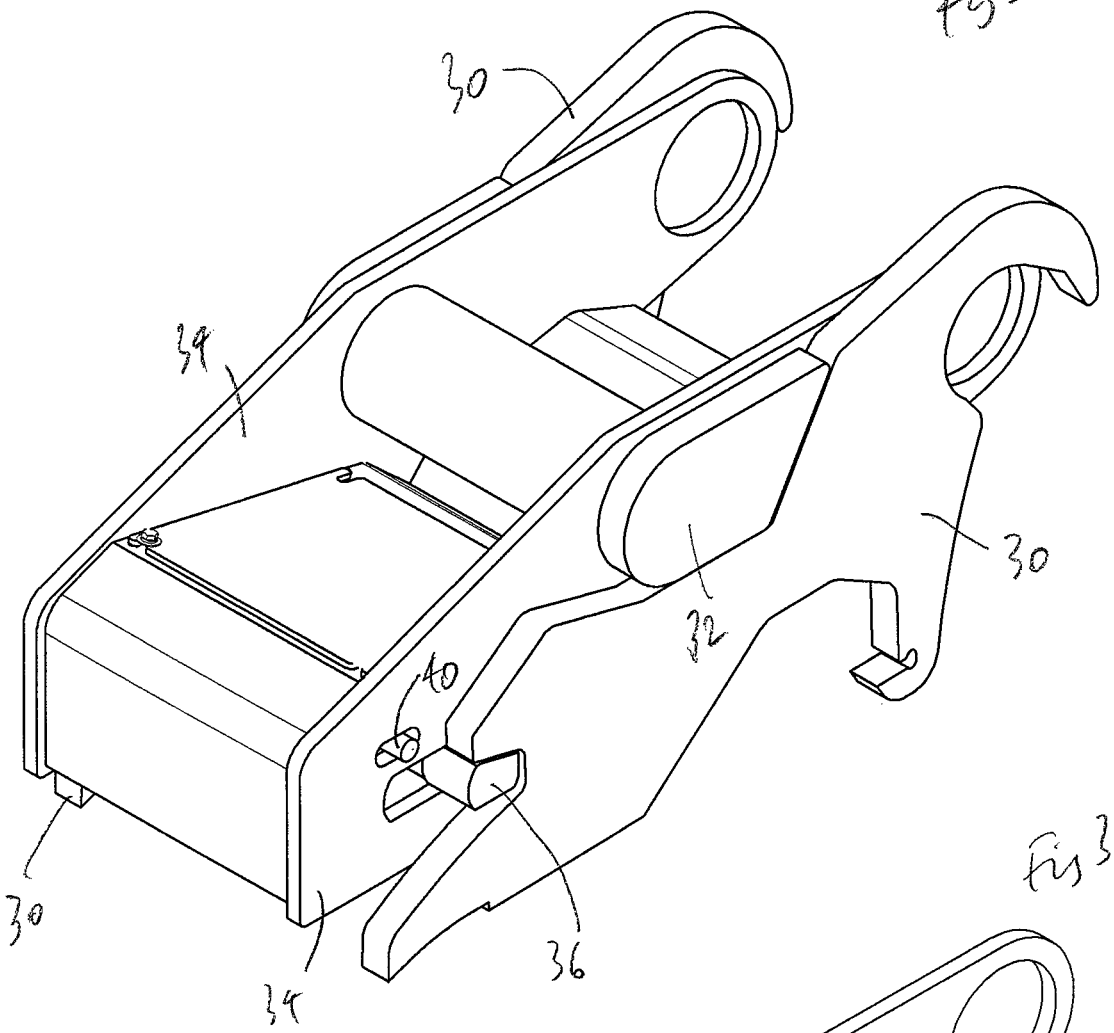
FIG. 3 is a similar view, showing an arm-end of the coupler-assembly coupled to, and locked to, bucket-lugs of a materials-handling bucket.
Figure 3A:
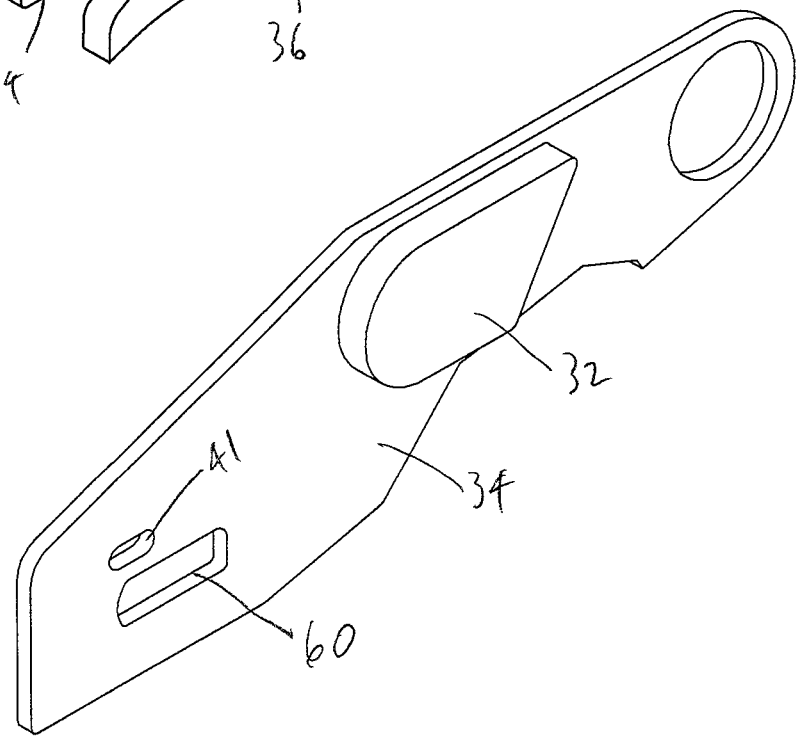
FIG. 3A shows a side-plate of the frame of the coupler-assembly, as a separate component.

FIG. 3 shows the bucket-lugs 30 now firmly and securely held with respect to the arm-end 25. The tenon 36 is tightly engaged into the mortise 38, and is held tight by hydraulic pressure. The lock-bolt 40 is engaged in the lock-slot 41, whereby the tenon 36 cannot release from the mortise 38, for security of attachment.

Figure 4:
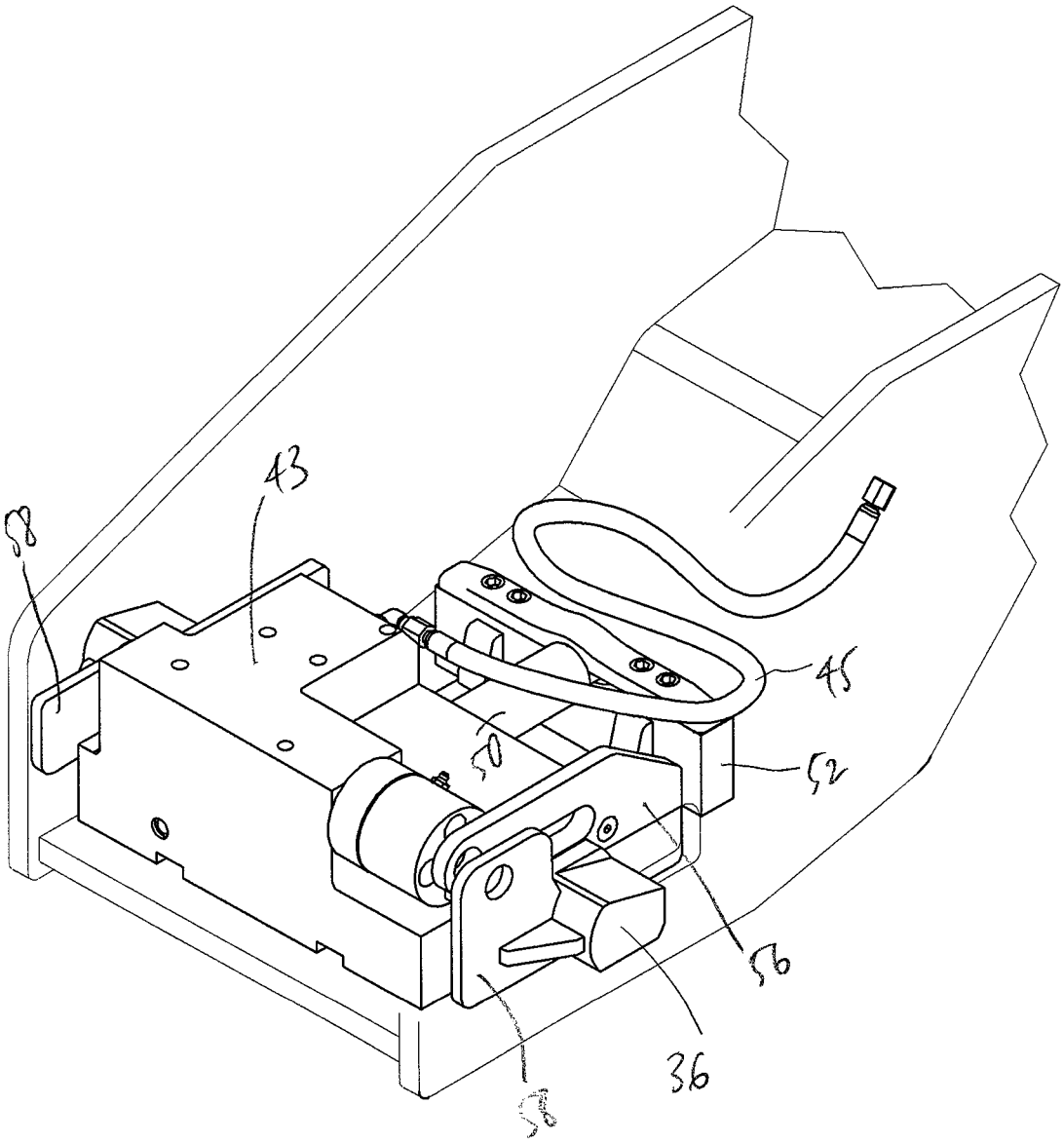
FIG. 4 is a similar view again, showing a sliding-block of the coupler-assembly, and a connecting hydraulic supply hose.
Figure 5:
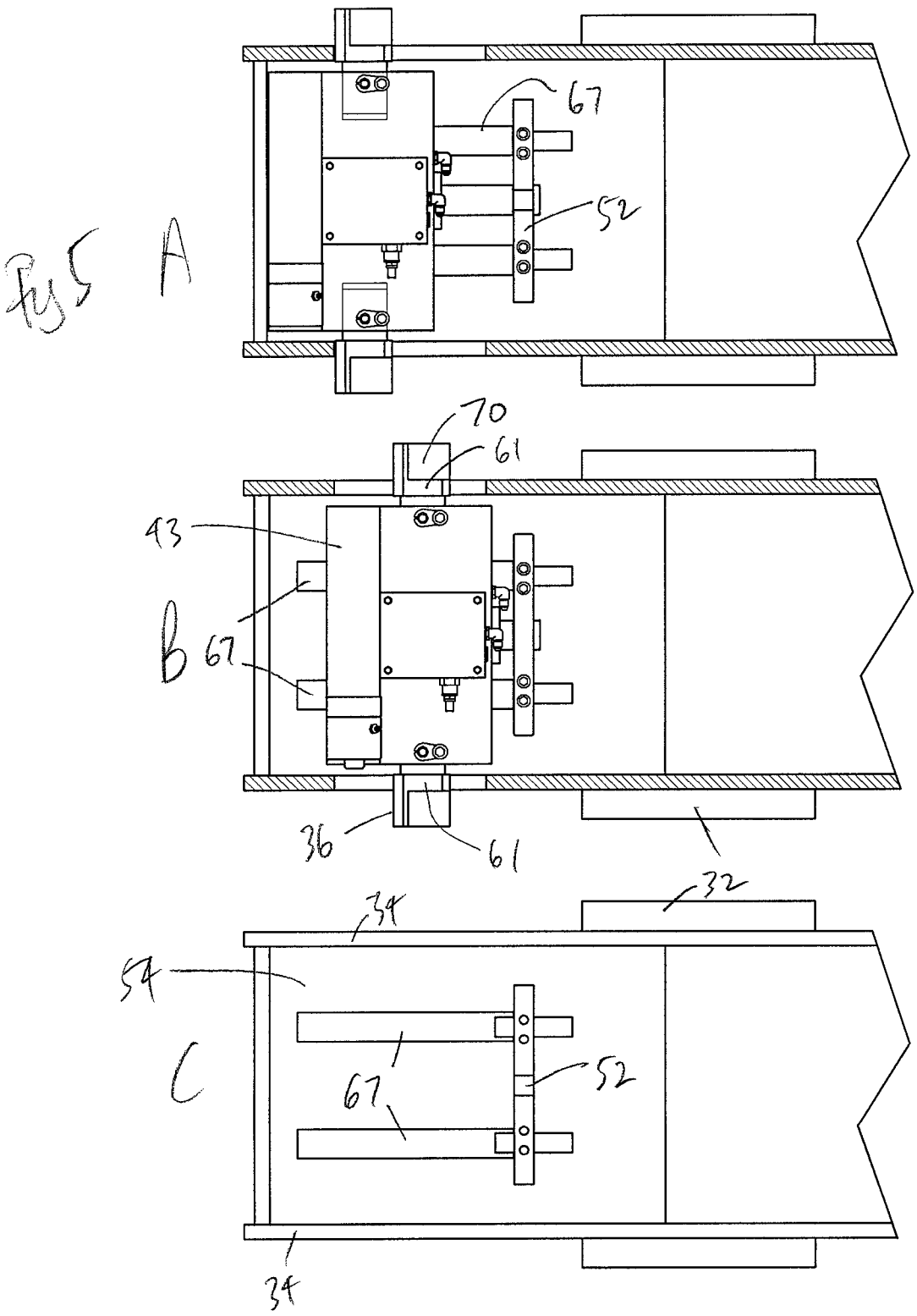
FIGS. 5A,5B are plan views of the coupler-assembly, shown at different stages of operation.
FIG. 5C is a plan view of a frame of the arm-end of the coupler-assembly.
Figure 6A:
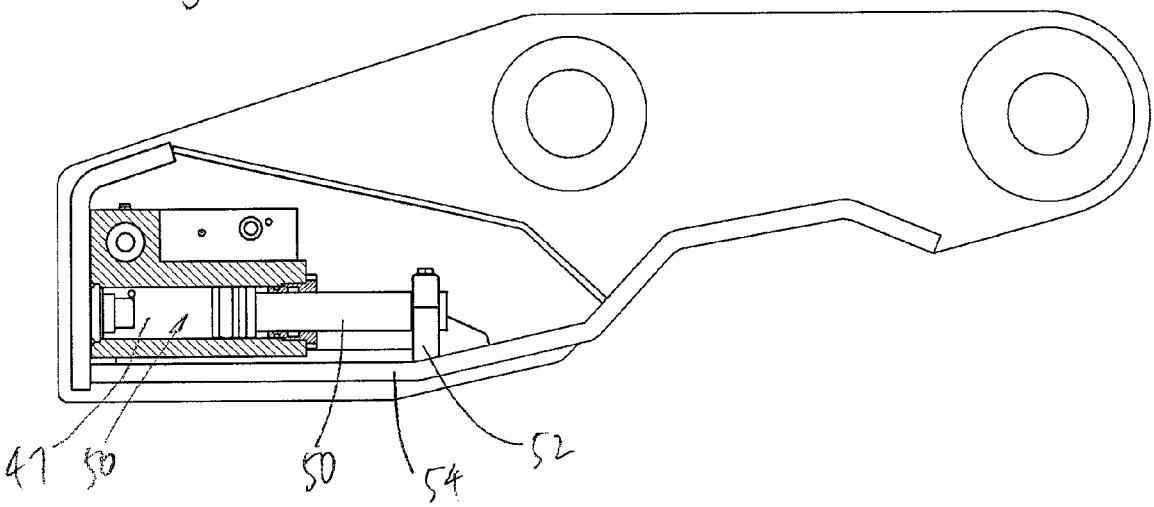
FIGS. 6A, 6B are side elevations of the coupler-assembly, shown at different stages of operation.
Figure 6B:
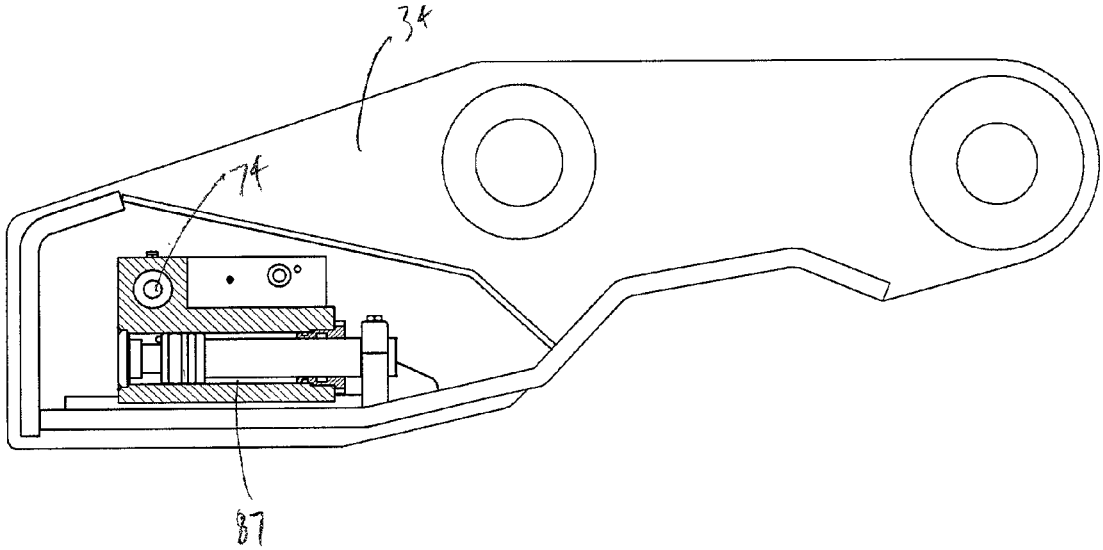

FIG. 4 shows some of the components that lie inside the frame 27 of the arm-end 25. The major component is the slider-block 43. The left and right tenons 36 are integrated into the slider-block. The hydraulic hose 45 (there are two hoses to the coupler-assembly, but only one is shown) conveys hydraulic oil from the mast or arm 23 of the front-end-loader or similar vehicle to the slider-block 43.

The end of the hose 45 is mounted on the arm 23, rather than on the arm-end 25. The hoses have to accommodate the full range of pivoting movement of the arm-end 25 about the pivot-pin 29. The hoses 45 have to accommodate the sliding movement of the slider-block 43 as well, but it is recognized that, by the time the hoses 45 have been arranged to accommodate the full range of pivoting movement, the small extra movement required for the movement of the slider 43 is insignificant. The hose 45 can be guided with respect to the frame of the arm-end, but preferably the end of the hose should not be fixed to the arm-end.

A hydraulic slider-ram 47 is built into the slider-block 43. A piston-rod 50 of the slider-ram 47 is movable relative to the slider-block, and the ram is operable to move the slider-block 43 to and fro, thereby moving the left and right tenons 36 into and out of engagement with the left and right mortises 38. A bolster 52 is fixed to the floor 54 of the frame 27 of the arm-end 25. The piston-rod 50 is clamped to the bolster 52, and thus to the frame 27. The cylinder of the slider-ram 47 is integrated into the slider-block 43. The bolster 52 is suitably buttressed to support the (considerable) forces created by the slider-ram 47.

Figure 7B:
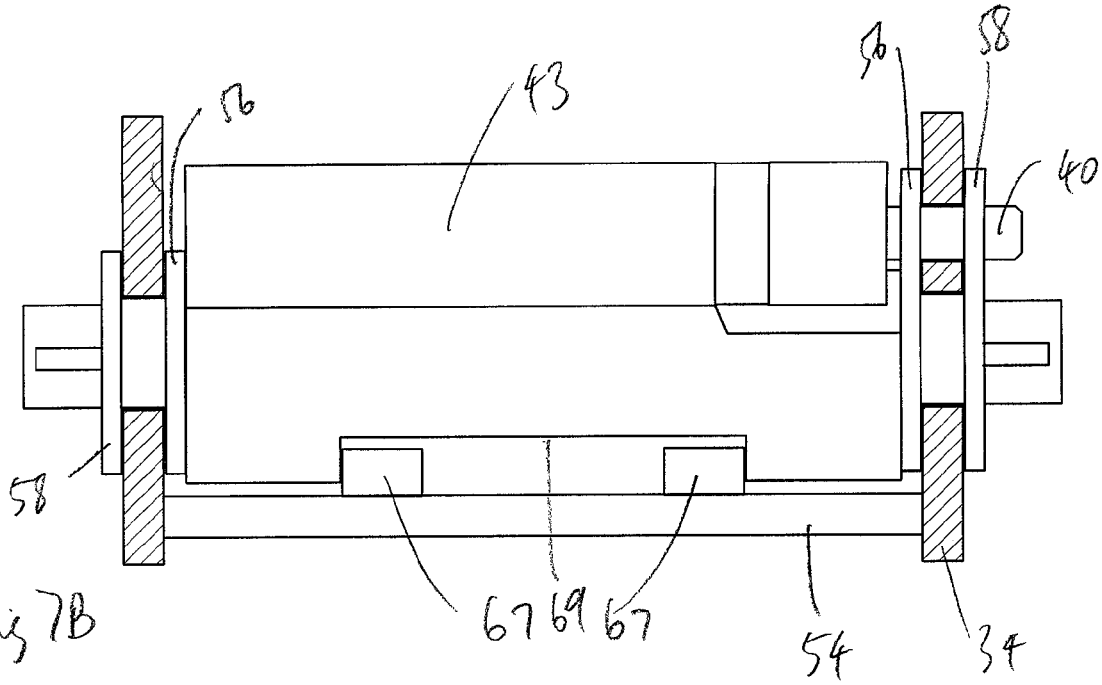
FIG. 7B is the same front elevation, but shows the dirt-shields carried by the sliding-block.
Figure 7A:
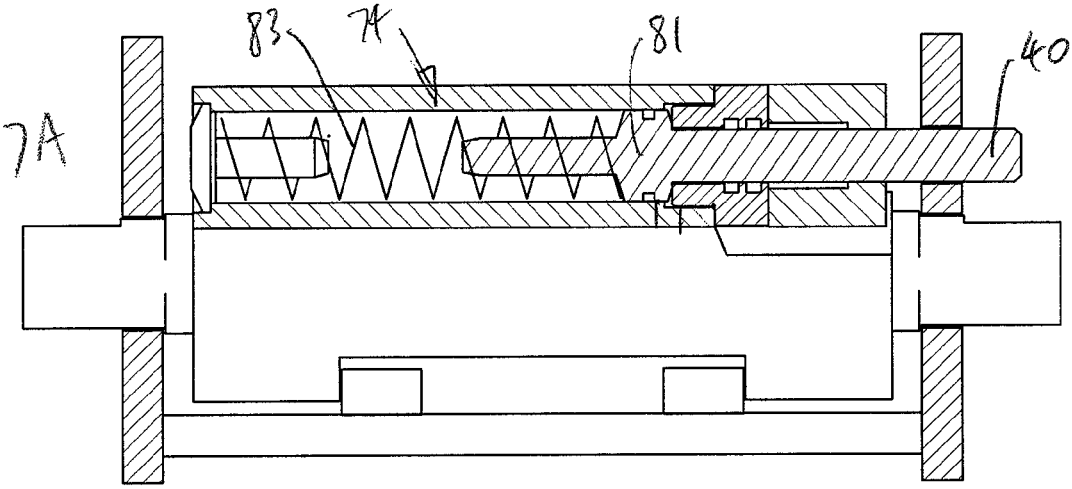
FIG. 7A is a front elevation of the coupler-assembly.
Figure 8:
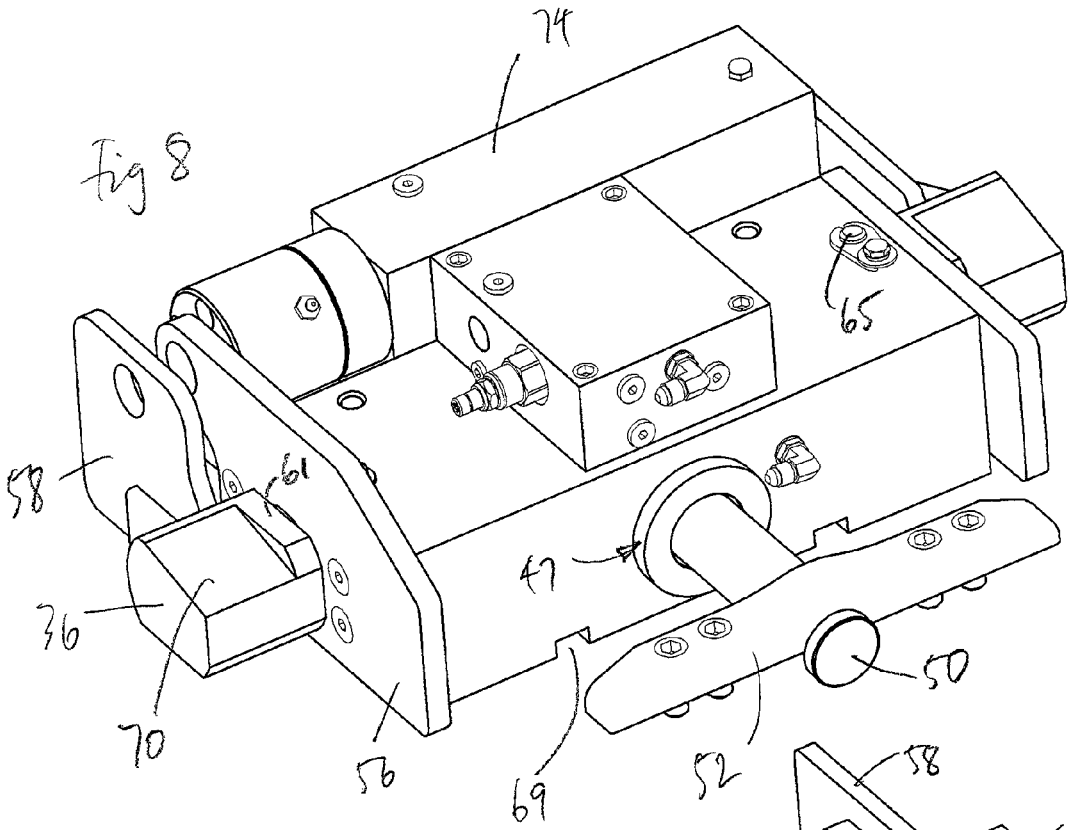
FIG. 8 is a pictorial view of the slider-block and associated components.
Figure 8A:
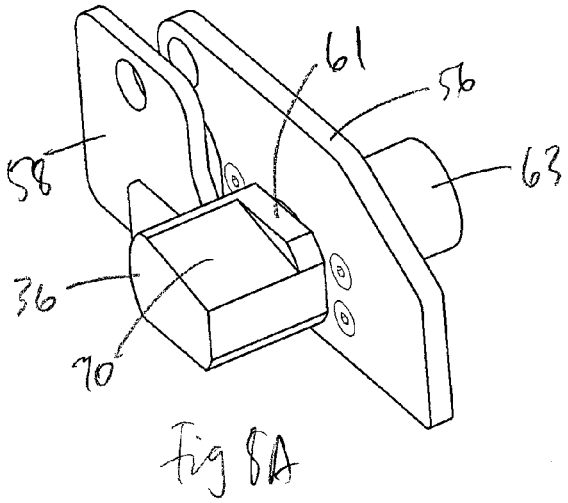
FIGS. 8A, 8B shows tenon wedges of the slider-block.
Figure 8B:
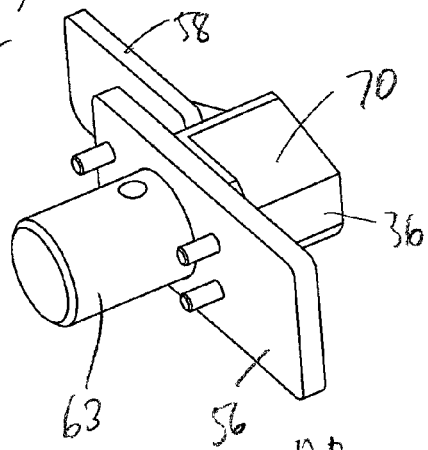

As shown in FIG. 4, inside and outside dirt-shields 56,58 are mounted on the tenons 36. (In some views, these dirt shields are not shown, for clarity.) FIGS. 8, 8A, 8B show the dirt-shields, which are integrated into (in this case, welded to) the tenons 36. As shown in FIG. 7B, the side-plate 34 of the frame 27 is sandwiched between the inside and outside dirt-shields 56,58. The dirt-shields should not touch the side-plate 34, but should have a running clearance. The clearance should be small enough to keep out dirt particles that are large enough possibly to interfere with the guides and slides.

Actually sealing the slider-slots 60 (and the lock-slot 41) might be preferred, but actual sealing is difficult.

As shown in FIGS. 8, 8A, 8B, the tenons are formed with respective cylindrical tenon-pins 63. The tenon-pins 63 fit into corresponding cylindrical holes formed in the slider-block. The tenon-pins 63 are locked into the holes by dowels 65, and also the inside dirt-shields 56, which are welded to the tenons 36, are bolted to the slider-block 43. Thus, the tenons are well-integrated into the slider-block 43.

FIGS. 5A-7B show how the slider-block 43 is constrained, in/by the arm-end frame 27, against all modes of movement relative to the frame—other than out-and-back sliding under the forces arising from the slider-ram 47.

The side-plates 34 of the frame 27 are formed with slider-slots 60. The tenon 36 is formed with upper 61 and lower slide-surfaces, which fit (with suitable clearance) between the upper and lower walls of the slider-slot 60. The engagement of the slide-surfaces of the tenons 36 with the walls of the slider-slots 60 in the arm-end frame 27 constrain the tenons (and with them, the slider-block 43) against up/down movements, and against roll-mode tipping of the slider-block. However, the engagement of the tenons 36 in the slider-slots 60 does not constrain the slider-block 43 against yaw-mode rotation, nor against side-to-side translational movements.

The presence of the dirt-shields 56,58, as shown in FIG. 7B, might be considered to provide the required anti-yaw and side-to-side constraints. However, relying on the dirt-shields for this purpose is not preferred. Rather, guide-rails 67 are provided, which are integrated into the floor 54 of the frame 27 of the arm-end 25, and a guide-recess 69 is provided in the slider-block 43, and the sides of the recess 69 engage (with suitable clearance) the sides of the guide-rails 67. It is this engagement that provides the required constraint against side-to side movements and against yaw-mode rotation of the slider-block 43.

Neither the engagement of the tenons 36 with the slider-slots 60, nor the engagement of the guide-recess 69 with the guide-rails 67, are effective to fully constrain the slider-block 43 against pitch-mode tipping. That constraint comes from the engagement of the piston-rod 50 of the slider-ram 47 with the bolster 52 of the arm-end frame 27.

The designers should see to it that the (very large) forces arising from the slider-ram 47 are applied in such manner as to avoid giving rise to unwanted tendencies of the slider-block 43 to tip and move in ways that will or might induce heavy contact forces in the sliding guides and components. Thus, the line of action of the slider-ram 47 should be symmetrically between the side-plates 34, and symmetrically between the upper and lower walls of the slider-slots 60. Also, the line of action of the ram should be parallel to the guide surfaces, to minimize forceful (and thus high frictional) contact within the guides.

Designers will understand, from a perusal of the drawings, just how very robustly the slider-block 43 is constrained and guided with respect to the frame 27. During operations, it can be expected that situations will arise that inhibit the smooth functioning of the slides and guides—perhaps due to poor maintenance, presence of caked dirt, and the like. If the arm-end were to be encased in set concrete, the present coupler-assembly might not be able to cope with that—but designers should expect the present design to provide such high rigidity and robustness of the slider-block and its guides that the assembly will cope with anything short of that.

It is important that the tenon be very tight in the mortise, during operation, such that there can be no relative movement between the bucket and the arm-end. The bucket-lug 30, having been snagged, nestles between the cheek-piece 32 and the pivot-pin 29. The required tightness of the bucket relative to the arm-end arises because the bucket-lug can be wedged into the space between the cheek 32 and the pivot-pin 29. The wedge-surface 70 on the tenon 36 engages the mortise 38, and drives the mortise in the upwards direction (in FIG. 3), i.e the counter-clockwise sense, whereby the bucket-lug 30 is driven more deeply into the space between the cheek 32 and the pivot-pin 29.

The force on the tenon 36 (arising from the slider-ram 47) is large, but that force is multiplied by the wedge action of the tenon 36 on the bucket-lug 30, and is multiplied again by the wedge action of the engagement of the bucket-lug between the cheek and the pivot-pin.

Figure 9B:
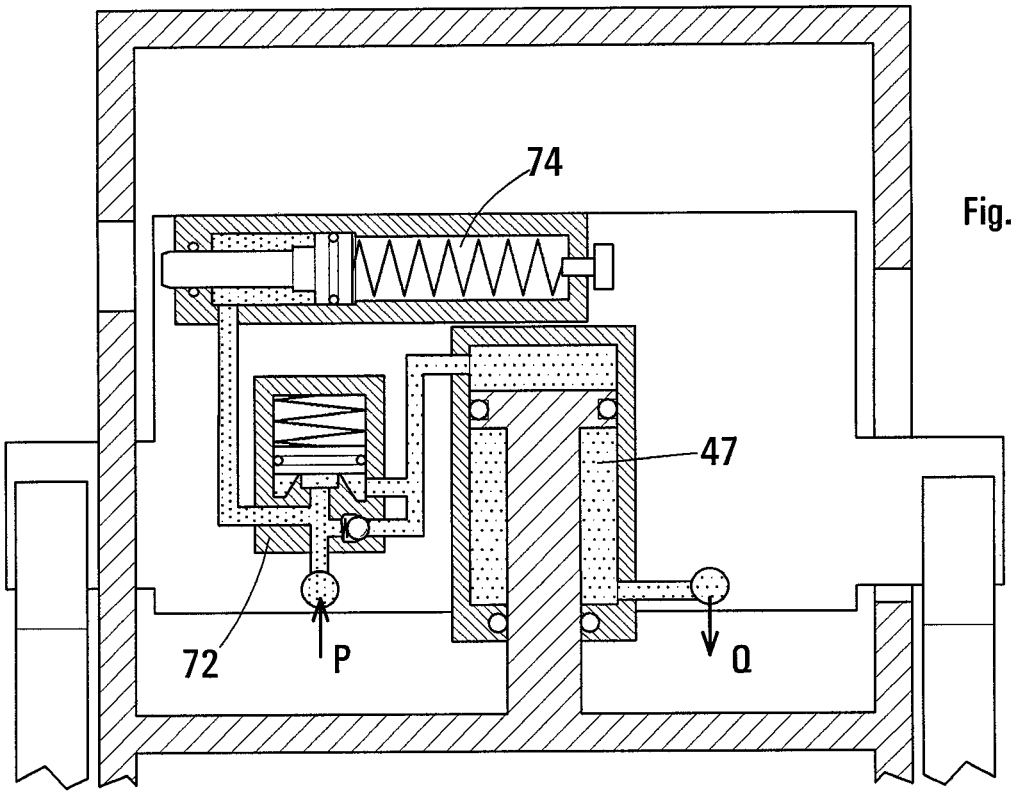
FIGS. 9A, 9B, 9C, 9D are diagrams depicting stages in the release of the bucket from the coupler-assembly.
Figure 9A:
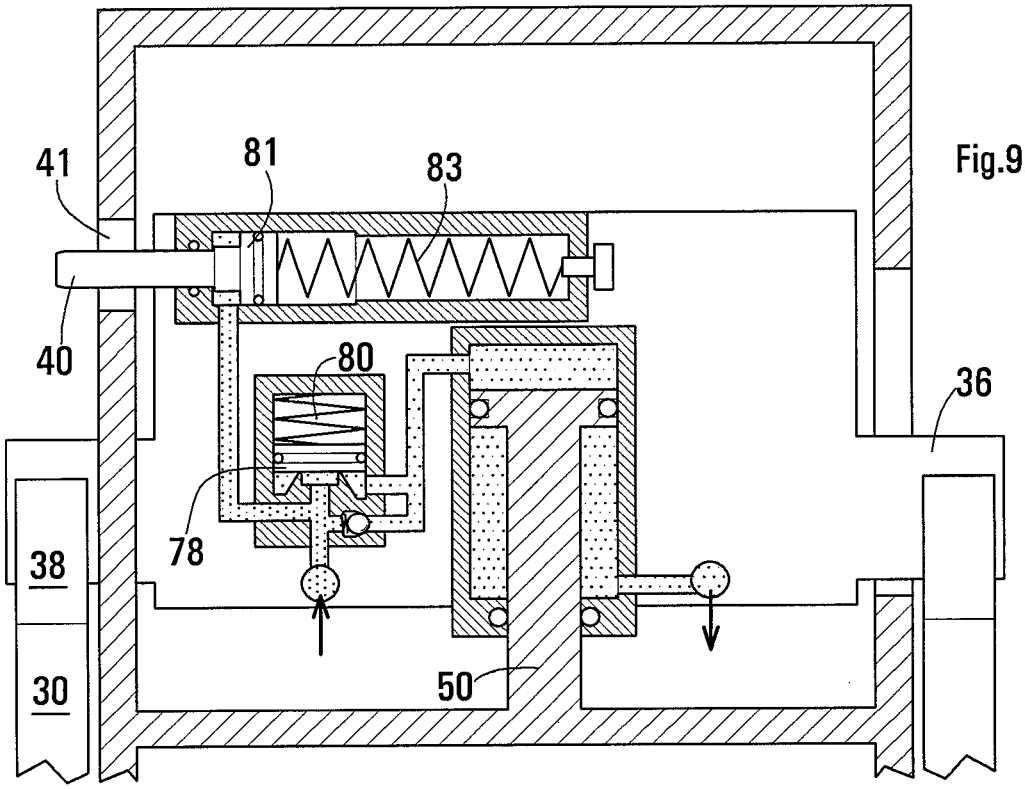

FIG. 9A is a diagram showing the arrangement of the slider components during operations with the bucket 20. The bucket is held tightly with respect to the frame 27 of the arm-end 25. In FIG. 9A, the driver has commenced the operation of detaching the bucket. The driver has switched the hydraulics such that the port-P is now connected to pressure, while the port-Q is connected to drain.

Now, oil flows into the sequence-valve 72 and passes into a lock-ram 74. In the sequence valve 72, the rising pressure acts over the (small) area of the valve-seat 76, creating an upward force on the sequence-piston 78. This force is opposed by the sequence-spring 80, which urges the sequence-piston 78 into contact with the valve-seat 76. The sequence-spring force is set at a level such that the hydraulic pressure needed to blow the sequence-piston 78 off the valve-seat 76 is higher than the pressure needed to drive the lock-piston 81 (and with it the lock-bolt 40) against the lock-spring 83. Thus, as the pressure rises, the designers ensure that the lock-bolt 40 is withdrawn (as in FIG. 9B) before the sequence-piston 78 cracks open form the valve-seat 76.

Figure 9D:
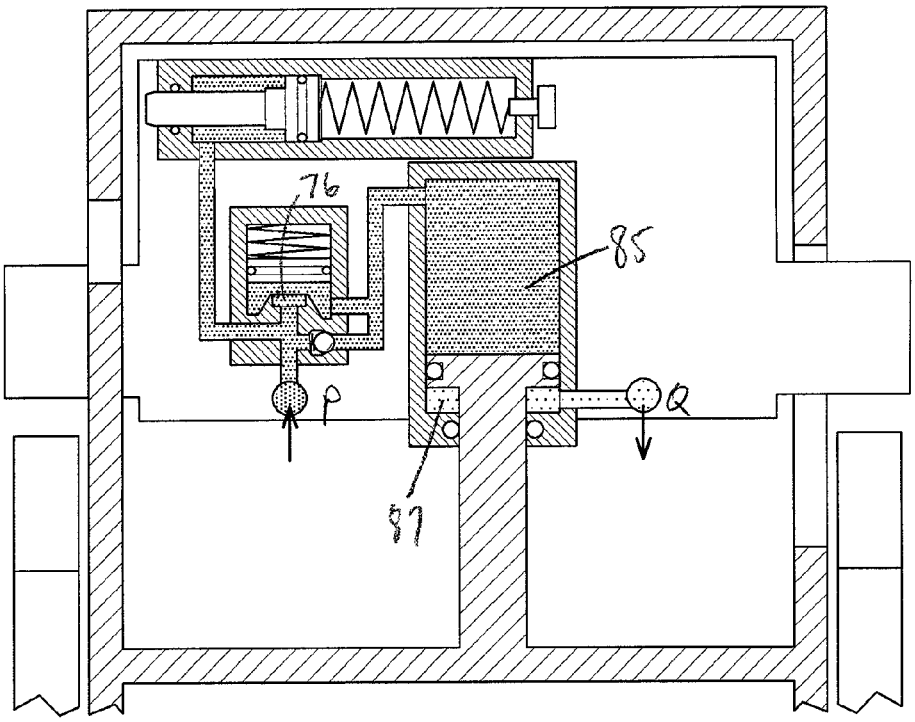
Figure 9C:
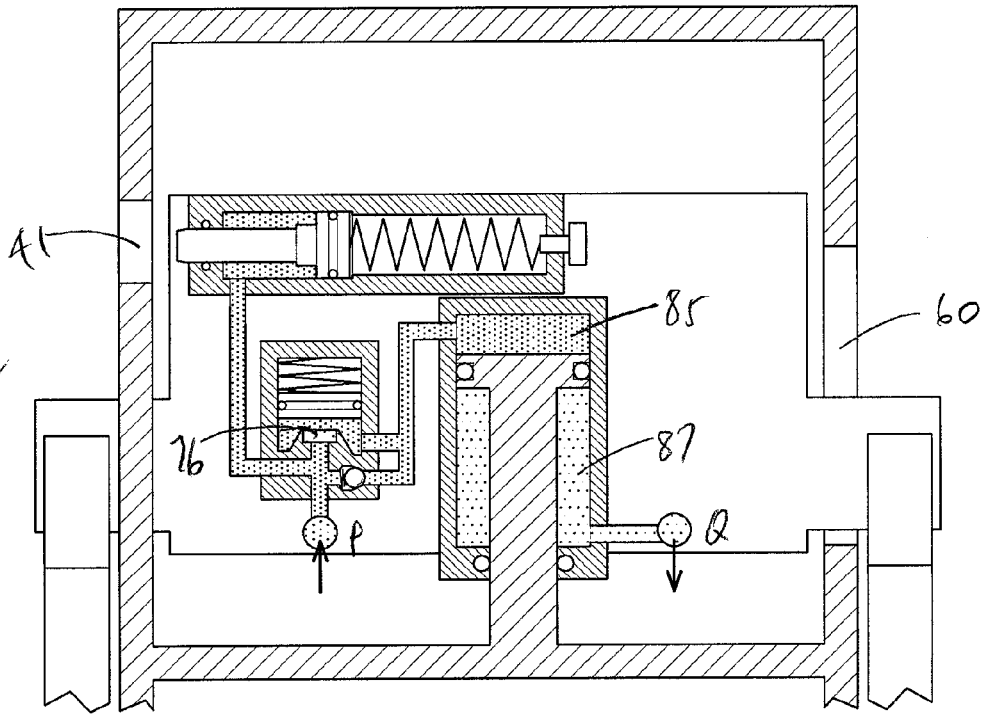

In FIG. 9C, the sequence-piston 78 has opened. As soon as the sequence-piston 78 cracks open, now the supply pressure in the port-P acts over the whole (large) surface of the piston 78, and the piston 78 rapidly moves against the sequence-spring 80 to its full-open position, as shown in FIG. 9C.

The sequence-valve 72 now being open, oil flows into the upper chamber 85 of the slider-ram 47. The lower (annular) chamber 87 being connected to drain, via port-Q, the slider-piston 50 moves downwards—or rather, the slider-block 43 starts to move upwards. The tenons 36 being integrated into the slider-block 43, the left and right tenons 36 now disengage from the left and right mortises 38. In FIG. 9D, the arm-end 25 is now free, and the driver is able to detach the arm-end 25 from the bucket 20.

The bucket 20 having been detached, probably the driver will now wish to engage another accessory, and so the driver maintains the slider in its withdrawn position, by maintaining the hydraulic pressure in the port-P and the drain in port-Q. The next accessory (again referred to herein as a bucket) is now attached, in the manner as shown in FIGS. 1A, 1B, 1C, 1D. The hydraulic operation may be seen in FIGS. 10A, 10B.

Figure 10B:
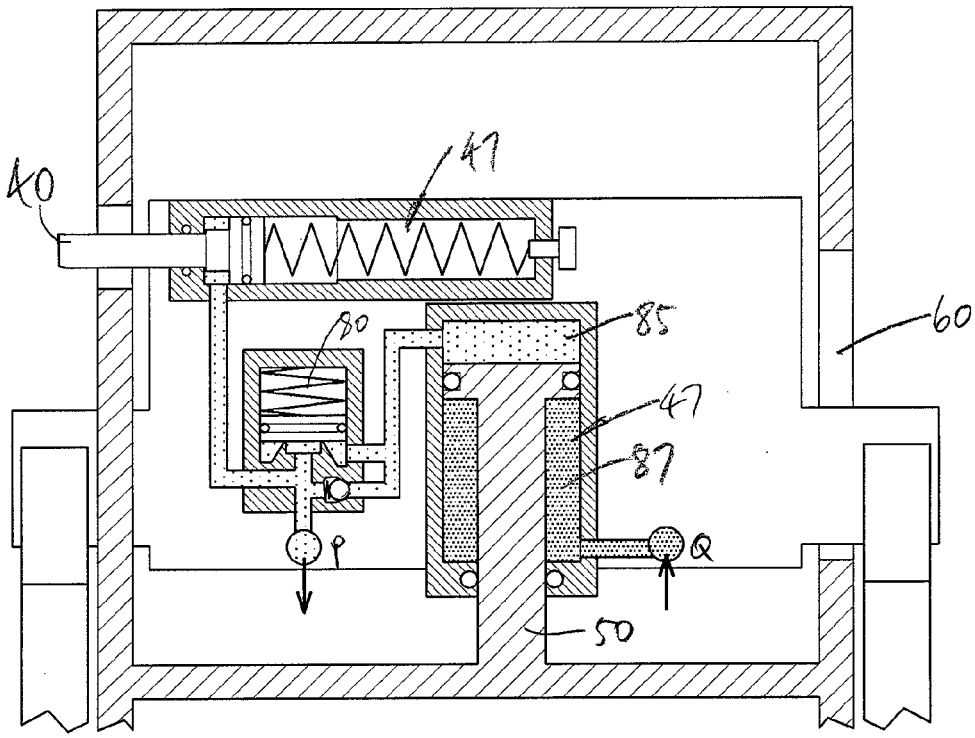
FIGS. 10A, 10B are diagrams depicting stages in the coupling of a bucket to the coupler-assembly.
Figure 10A:
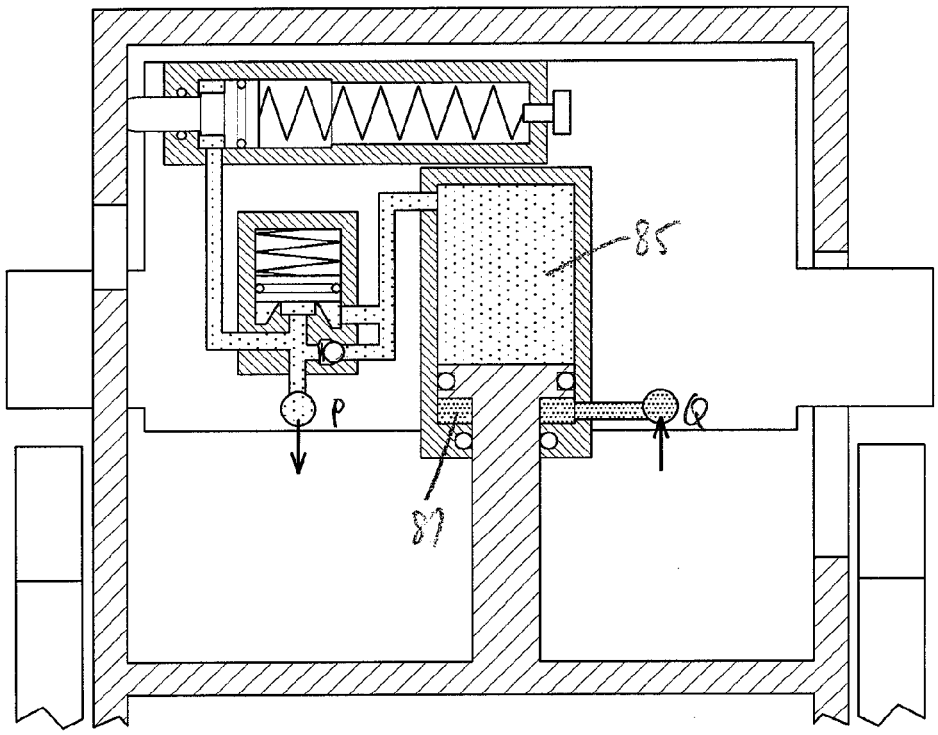

In FIG. 10A (which corresponds to FIG. 1D), the driver switches the pressure now to port-Q, and the drain to port-P. The lock-spring 83 urges the lock-bolt 40 to the left, where it presses against the side-plate 34 of the frame 27 of the arm-end 29. At the same time, the annular chamber 87 of the slider-ram 47 accepts pressure, causing the slider-block 43 to move downwards. The tenons 36 being integrated into the slider-block, they move into engagement with the mortises 38. As the slider-block 43 moves, the end of the lock-bolt 40 slides along the face of the side-plate 34 towards the lock-slot 41, until the lock-spring 83 makes the lock-bolt 40 drop into the lock-slot 41 in the side-plate 34. Once the lock-bolt 40 has engaged the lock-slot 41, the lock-bolt cannot release from the lock-slot other than by the application of hydraulic pressure to the lock-ram 74, as shown in FIG. 9B.

It may be noted that the end of the lock-bolt 40 protrudes out from the side-plate 34, when the lock is locked. Thus, it is an easy matter to ensure that the protruding end of the lock-bolt 40 is visible to the driver of the vehicle. The protruding end can be painted in a contrasting colour, to increase the driver's confidence that the lock-bolt 40 is correctly engaged. The driver can remain seated, and does not have to get down to carry our some such operation as removing a locking safety pin.

FIG. 10B shows the hydraulic pressure in port-Q being maintained, during operations, causing the tenons 36 to press very tightly into the mortises 38. The bucket 20 is now very securely fast to the arm-end 25—to the extent that even violent abusive forces and impacts suffered by the bucket cannot dislodge the bucket. That is to say, the bucket 20 remains tightly integrated into the arm-end 25 even during violent abuse, without any free play or relative movement.

If the hydraulic pressure should fail during operation, generally the driver will be immediately aware of the problem, and will cease operations. Now, the hydraulic-pressure having disappeared, the tenons 36 will tend to detach from the mortises 38, or at any rate a clearance will open up between the tenons and the mortises. As mentioned, it is important for safety reasons that the bucket 20 cannot actually detach and from the arm-end 25, and fall to the ground, at such a time. The engagement of the lock-bolt 40 into the lock-slot 41 in the side-plate 34 ensures that the bucket 20 indeed cannot fall off the arm-end 25. Indeed, the bucket remains locked to the arm-end until hydraulic pressure is restored—whereupon the operations of FIGS. 9A, 9B, 9C, 9D can be put into effect.

It may be noted that, even though the arm-end might be covered with e.g frozen mud, large forces can be brought to bear to move the slider-block 43, in either direction. The slider-block, with all the elements integrated thereinto, is chunky and hugely robust. The slide-guides, too, are almost as robust. The present guided slider may be contrasted with e.g. pivoting levers, from the standpoint of robustness, and it may be noted that a pivoting-lever arrangement that is as robust as the present guided slider (even if such could be achieved) would likely be much more expensive. There is virtually no danger that, should the slide-ways become choked with accumulated solid debris, the slider and its guides might not be able to support even the highest forces that might be encountered as the driver seeks to get the slider moving by applying hydraulic pressure. It cannot be said that the slider and the guides are indestructible, but it can be said that the chances of the slider and the arm-end being damaged by forces arising from misapplication of hydraulic pressure in the rams, is virtually zero.

The lock-bolt 40 operates on only one of the left and right side-plates 34, but it could be arranged that the lock-ram 74 is double-ended, and operates a lock-bolt also on the other side-plate. However, a single lock-bolt is considered adequately safe.

Figure 11B:
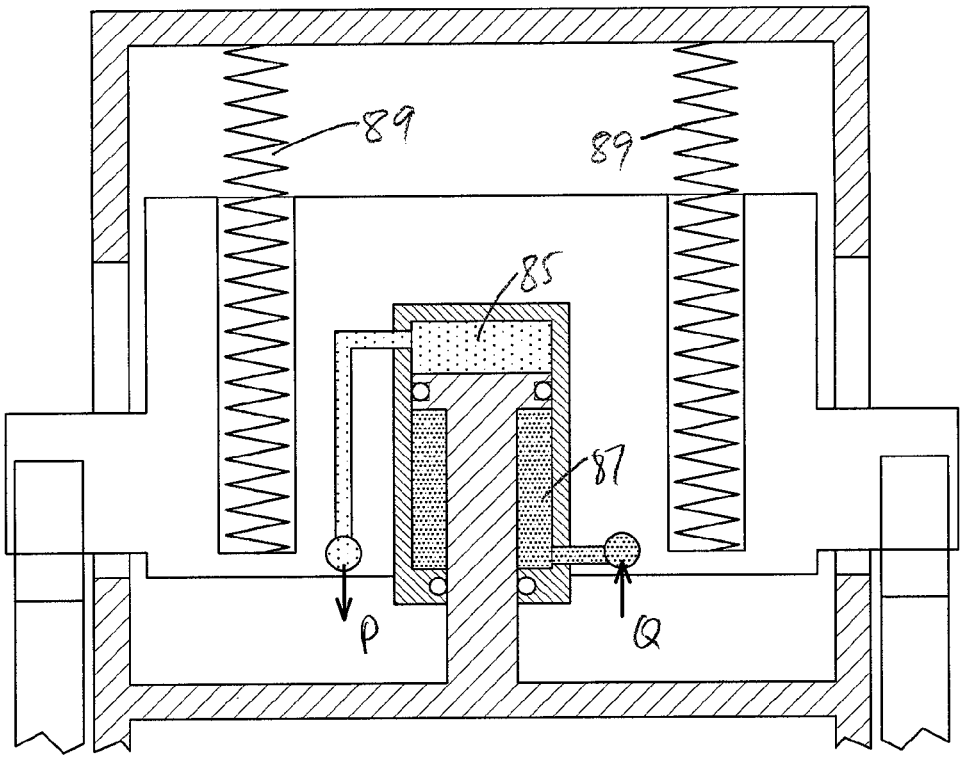
FIGS. 11A, 11B are similar diagrams depicting another form of coupler-assembly.
Figure 11A:
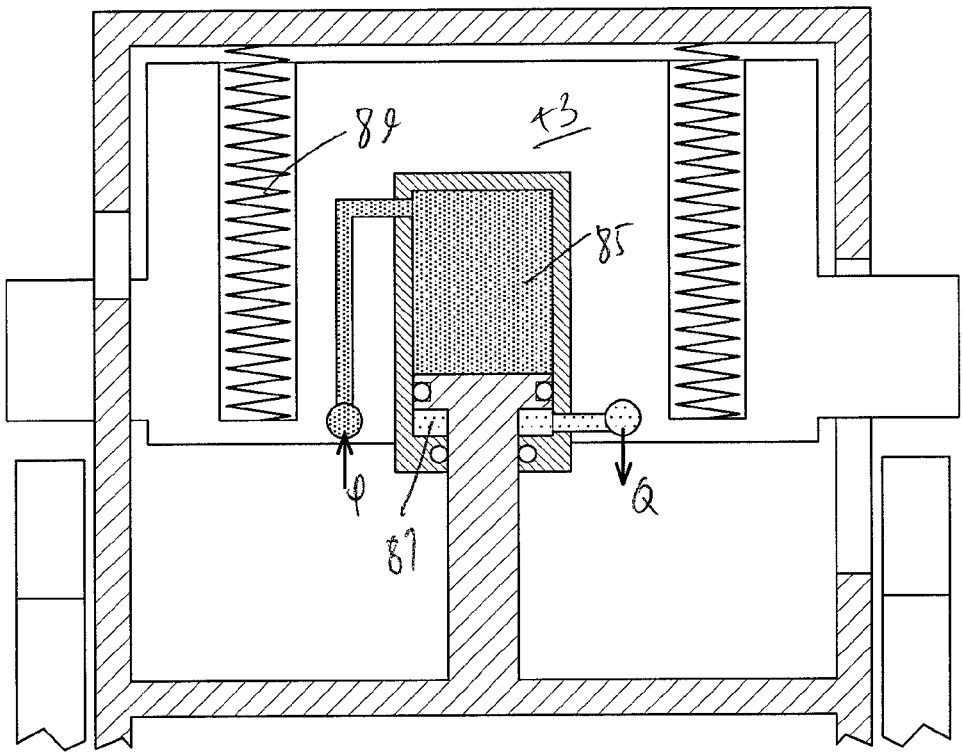

FIGS. 11A, 11B show an alternative approach to the bucket-must-not-fall-off safety requirement. Here, the slider-block 43 is provided with slider-springs 89, which urge the slider-block constantly in the direction to drive the tenons 36 into tight engagement with the mortises 38. However, the slider-springs 89 cannot conveniently be made strong enough to be capable of exerting enough force, by themselves, to keep the tenons engaged in the mortises as tightly as the designers desire for abusive operations.

Designers do not rule out the use of springs to keep the tenons tightly engaged with the mortises and of using hydraulic pressure to release the springs—following the common traditional fail-safe approach. However, in that case, the spring-force required would be so high, and the distance travelled by the springs would be so large, that the springs and their mountings would be expensive; not only that, but users of materials-handling equipment would likely balk at the presence of the dangerously large amounts of potential energy necessarily stored in such springs.

Rather, in the present case, designers prefer to use maintained hydraulic pressure, as described, as the means for ensuring that the tenons remain adequately-tightly engaged in the mortises during operations. Hydraulic rams can apply the required large forces, controllably and safely. However, using hydraulic pressure is not inherently fail-safe.

FIGS. 11A, 11B show a compromise. Here, the slider-springs 89 are strong enough to ensure that the tenons cannot release from the mortises in the event of hydraulic failure. It is emphasized that the slider-springs 89 are not strong enough to keep the tenons so tightly engaged with the mortises that the tenons remain tight even during the impacts and abusive forces that can arise during typical materials-handling operations. The force needed to keep the tenons sufficiently tight in the mortises to properly perform normal operations is, typically, e.g. ten times the force that is needed to ensure that the bucket cannot fall off the arm-end in the event of hydraulic failure. This required high degree of tightness of the tenons, for the purposes of normal operations, is achieved by maintained hydraulic pressure in port-Q as shown in FIG. 11B—and as was shown in the previous drawings.

It may be noted that, in many systems where fail-safe operation is required, the force that is needed to ensure safety, in the event of failure, is the maximum force that ever arises in the system. In the present case, the force needed to ensure safety is much smaller than the normal operating forces. Thus, the use of springs to perform the safety function, in the manner as indicated in FIGS. 11A, 11B, can be especially advantageous.

One of the benefits of the coupler-assembly as described herein is that the operator is faced with just one single operation to couple the bucket. When releasing the bucket, the lock-bolt is automatically sequenced to withdraw before the slider-block can start to move. The operator does not have to remember to unlock the bolt before making the slider move.

As illustrated, the slider-block itself is monolithic, i.e is formed from a single piece of material.

Some of the terms used herein are intended to be construed as follows. The slider-assembly includes components that are rigidly integrated into the slider-block, as well as the slider-block itself. The hydraulic ram-cylinder of the slider-ram is formed directly in the block of material that is the slider-block, in the assemblies as illustrated herein, but designers might prefer to use a separately-manufactured ram-cylinder, and e.g to bolt that separate ram-cylinder rigidly to the slider-block. Similarly, the tenon or tenons can be manufactured separately from the slider-block. The slider-assembly performs operational functions in the same manner whether the cylinder and the tenon(s) are monolithic with or separate from the slider-block.

In the relationship of a mortise and tenon as referred to herein, the tenon is a component of the slider and the mortise is a component of the bucket-lug. Included also is the opposite relationship, where these components are reversed.

It is important that the coupler-assembly should hold the bucket very tightly to the frame of the arm-end—even during the abuse that is inevitably encountered by the bucket of a front-end loader. It might be considered that, although, of course, the bucket must be prevented from actually detaching accidentally from the arm, but still, the bucket could be allowed to move, somewhat, relative to the arm-end. That is to say: it might be considered that, so long as the bucket cannot actually fall off, it does not matter if the bucket can "rattle" relative to the arm-end.

However, it is recognized that any clearance at all between the bucket-lugs and the arm-end is contra-indicated. The bucket-lugs should be pressed tight against/into the arm-end throughout operation. In order for the coupling between the bucket-lugs and the arm-end frame to remain tight even under abusive conditions, the coupling should be very tight indeed under no-load conditions. Also, the tightness should be automatic, i.e the design of the coupler-assembly should be such that even a casual and inept driver should not be able to start work using the bucket until the bucket is tight.

The slider-ram therefore should exert a considerable force, and should maintain that force throughout operation. Plus, it is advantageous if the force from the slider-ram can be multiplied in such manner as to magnify that attachment force. In the coupler-assembly as shown, the shape of the bucket-lug is such that the lug becomes wedged in the space between the arm-end pivot-pin and the cheek-piece, during snagging of the bucket. The tightness of the attachment depends mainly on that wedge-engagement being held tightly. Thus, the frame of the arm-end should be rotated about the pivot-pin in such manner as to wedge the bucket-lug more tightly into that space.

Furthermore, the contact-surfaces of the tenon and the mortise preferably should be angled in such manner that, when the slider-ram forces those two surfaces into contact, that contact also forcefully causes the arm-end to rotate about the pivot-pin, thus driving the bucket-lug more deeply into the arm-end frame.

Regarding the out-and-back sliding of the block relative to the frame, as constrained by the guided-rails and the recess in the slider-block, the designers will see to it that there is a running clearance between the rails and the recess, to permit free sliding. This clearance also permits the block to undergo a small degree of yaw-mode rotation relative to the frame. This is advantageous, in that such rotation permits the slider-block to rotate in the yaw-mode until the contact force between the left tenon and mortise is equal to the contact force between the right tenon and mortise. Over time, there will inevitably be some wear between the mortise and tenon contact-surfaces, and such wear is likely to be uneven, left to right—whereby equalization between the left and right tenons might not be assured unless the block were permitted to rotate slightly in the yaw-mode.

The hydraulic circuit requires two fluid lines (P,Q) to connect the coupler-assembly to the source of hydraulic pressure ion the vehicle. When line Q is pressurized, the slider is urged towards it engaged position; the lock-ram is not pressurized, so the lock-spring urges the lock-bolt to its locked position. When line P is pressurized, first the lock-ram is pressurized and then the slider-ram is pressurized to urge the slider to it dis-engaged position. No other control is required of the driver, other than to switch the pressure either to line P or to line Q.

The scope of the patent protection sought herein is defined by the accompanying claims. The apparatuses and procedures shown in the accompanying drawings and described herein are examples.

Terms of orientation (e.g "up/down", "left/right", and the like) when used herein are intended to be construed as follows. The terms being applied to a device, that device is distinguished by the terms of orientation only if there is not one single orientation into which the device, or an image (including a mirror image) of the device, could be placed, in which the terms could be applied consistently.

Terms used herein, such as "cylindrical", "vertical", and the like, which define respective theoretical constructs, are intended to be construed according to the purposive construction.

Herein, "rigid" means, rigid for the purposes of practical operation of the coupler-assembly. That is to say: any difference between actual rigidity and theoretically-absolute rigidity is insignificant from the standpoint of practical operation of the coupler-assembly.

A reference to a component being "integrated into" another component means, herein, that the two components are either formed monolithically from one common piece of material, or, if formed separately, are fixed together so firmly and rigidly as to be functionally and operationally equivalent to having been formed monolithically. Two components should not be regarded as "integrated", in this sense, if the components can undergo relative movement, during operation.

The scope of the patent protection sought herein is defined by the accompanying claims. The apparatuses and procedures shown in the accompanying drawings and described herein are examples.

The numerals that appear in the accompanying drawings are listed as:

20 bucket
21 coupler-assembly
23 articulating arm
25 arm-end, pivoted to arm
27 frame of arm-end
29 arm-end-pivot-pin
30 bucket-lug
32 cheek-piece
34 side-plate of arm-end frame
36 tenon
38 mortise, formed in bucket-lug 30
40 lock-bolt, mounted on slider-block
41 lock-slot in side-plate 34
43 slider-block
45 hydraulic hose
47 slider-ram
50 piston-rod of slider-ram 47
52 bolster, integrated into frame 27
54 floor of frame
56 inside dirt-shield
58 outside dirt-shield
60 slider-slot in side-plate 34
61 upper-slide-surface of tenon 36
63 tenon-pin
65 tenon-pin dowel
67 guide-rail in floor 54
69 guide-recess in underside of slider-block 43
70 wedge-surface on tenon
72 sequence-valve
74 lock-ram
76 valve-seat in sequence-valve 72
78 sequence-piston
80 sequence-spring
81 lock-piston
83 lock-spring
85 upper chamber of slider-ram 47
87 lower (annular) chamber of slider-ram 47
89 slider-springs slider runs in slide-guides, moved by hydr slider ram, tenon-mortise engagement

The invention claimed is:

1. A coupler-assembly for attaching a bucket or the like to a movable arm of a front-end loader or other vehicle, wherein:

(a) the coupler-assembly includes a bucket-lug of the bucket, by which the bucket can be attached to the coupler-assembly, and the bucket-lug includes a mortise;

(b) the coupler-assembly includes an arm-end, having a frame;

(c) the arm-end is mounted for pivoting with respect to a distal end of the arm, about an arm-end pivot pin;

(d) the coupler-assembly is operable to couple the bucket to, and to uncouple the bucket from, the arm-end; and (e) the arm-end includes a slider-assembly within the frame, which slider-assembly includes a slider-block and a tenon rigidly integrated therewith;

(f) the mortise and the tenon have respective contact surfaces;

(g) the slider-assembly is mounted in slide-guides integrated within the arm-end frame for out-and-back sliding with respect to the frame;

(h) the slide-guides and the frame constrain the slider-assembly against all modes of movement of the slider-assembly relative to the frame, other than the out-and-back sliding mode, in which the respective contact-surfaces of the tenon and mortise move into and out of contact with each other;

(i) the coupler-assembly includes a hydraulic slider-ram with a cylinder rigidly integrated into the slider-block, which acts between the slider-assembly and the frame, and is operable to move the slider-assembly forcefully in the said out-and-back mode;

(j) the coupler-assembly is so structured that, when the contact-surfaces are forcefully driven together, the bucket becomes proportionately more forcefully and more rigidly engaged with the arm-end.

2. The coupler-assembly as claimed in 1, wherein the coupler-assembly is so arranged as to maintain forceful contact between the contact surface of the tenon and the contact surface of the mortise, while the bucket is coupled to the arm-end.

3. The coupler-assembly as claimed in 2, wherein:

(a) the coupler-assembly is so structured that the slider-assembly is constrained to slide between a bucket-engaged position and a bucket-disengaged position;

(b) the slider-ram includes a hydraulic port-P, which is supplied with hydraulic fluid under pressure from the vehicle, under the control of the driver, for operating the slider-ram between those positions.

4. The coupler-assembly as claimed in 1, wherein:

(a) the bucket includes a left bucket-lug and a right bucket-lug;

(b) the tenon is termed the right tenon, and the slider-assembly includes also a left tenon;

(c) the frame of the arm-end includes left and right side-plates;

(d) left and right tenon-slider-slots are formed in the side-plates;

(e) the left and right tenons are formed with respective slider-surfaces, which engage walls of the tenon-slider-slots;

(f) the slide-guides are created by the engagement of the tenon slider-surfaces with the tenon slider-slots.

5. The coupler-assembly as claimed in claim 1, wherein:

(a) the coupler-assebmly includes a mechanical lock acting between the slider assembly, the bucket lug and the frame;

(b) the lock is directly driven by the slider-ram by hydraulic means within the slider-assembly and is so structured that, if hydraulic pressure should fail during operation of the coupler-assembly, the lock prevents the tenon from disengaging from the mortise;

(c) the lock is arranged to operate in fail-lock mode, in that the lock remains locked upon failure of hydraulic pressure, and in that hydraulic pressure is required to enable the lock to be unlocked, and thereby to allow the tenon to disengage from the mortise.

6. The coupler-assembly as claimed in 5, wherein:

(a) the lock includes a lock-bolt, and a lock-ram;

(b) the lock-ram is a component of the slider-assembly;

(c) the arm-end frame includes a lock-slot;

(d) the lock-ram is operable, upon the contact-surfaces of the tenon and the mortise being driven together by the slider ram, to drive the lock-bolt into the lock-slot.

7. The coupler-assembly as claimed in 6, wherein the lock-ram is operable, upon the contact-surfaces of the tenon and the mortise being driven together by the slider ram, to drive the lock-bolt through the lock-slot for exposure of a portion of the lock-bolt to the exterior of the frame.

8. The coupler-assembly as claimed in 5, wherein:

(a) the lock includes a lock-bolt, and a lock-ram; and (b) the lock-ram includes a lock-spring, force from which urges the lock-bolt in the direction to engage the lock-bolt with the lock-slot; and (c) the lock-ram is so structured that hydraulic pressure applied to the lock-ram causes the lock-bolt to withdraw from the lock-slot.

9. The coupler-assembly as claimed in 1, wherein:

(a) the slider-ram includes hydraulic port-P and port-Q, and the arrangement of the coupler-assembly is such that hydraulic pressure can be applied to port-Q or alternatively to port-P selectably by the driver of the vehicle, the other port being then connected to drain;

(b) the slider-ram is double-acting, having two ports, and is so arranged that:

i. when pressure is applied to port-P, the slider-ram moves the slider-assembly to its dis-engaged position; and ii. when pressure is applied to port-Q, the slider-ram moves the slider-assembly to its engaged position;

(c) a conduit-P of the coupler-assembly conveys hydraulic fluid to and from the port-P of the slider-ram, and the coupler-assembly is so arranged that, when pressurized fluid is present in the conduit-P, the fluid first pressurizes the lock-ram, and causes the lock-ram to withdraw the lock-bolt, before the pressurised fluid is applied to the port-P of the slider-ram.

10. The coupler-assembly as claimed in 1, wherein:

(a) the coupler-assembly includes a hose-P, one end of which is attached to the arm, and (b) the other end to a port-P in the cylinder of the slider-ram; the hose is flexible enough to permit the arm-end to pivot through a substantial range of movement relative to the arm; the range of movement to be accommodated by the flexibility of the hose includes rotational movement of the slider-ram relative to the arm, and includes sliding movement of the slider-ram relative to the frame; the hose is so mounted in the coupler-assembly as not to inhibit such movements.

11. The coupler-assembly as claimed in 1, wherein:

(a) the arm-end frame includes left and right side-plates rigidly integrated to a floor; and (b) the slider-block slides on guide-rails engaging with a recess, and is thereby constrained to move only in the out-and-back mode relative to the floor of the frame.

12. A coupler-assembly for attaching a bucket or the like to a movable arm of a front-end loader or other vehicle, wherein:

(a) the coupler-assembly includes a bucket-lug of the bucket, by which the bucket can be attached to the coupler-assembly, and the bucket-lug includes a mortise;

(b) the coupler-assembly includes an arm-end, having a frame;

(c) the arm-end is mounted for pivoting with respect to a distal end of the arm, about an arm-end pivot pin;

(d) the coupler-assembly is operable to couple the bucket to, and to uncouple the bucket from, the arm-end; and (e) the arm-end includes a slider-assembly within the frame, which slider-assembly includes a slider-block and a tenon rigidly integrated therewith:

(f) the mortise and the tenon have respective contact surfaces;

(g) the slider-assembly is mounted in slide-guides integrated within the arm-end frame for out-and-back sliding with respect to the frame;

(h) the slide-guides and the frame constrain the slider-assembly against all modes of movement of the slider-assembly relative to the frame, other than the out-and-back sliding mode, in which the respective contact-surfaces of the tenon and mortise move into and out of contact with each other;

(i) the coupler-assembly includes a hydraulic slider-ram which acts between the slider-assembly and the frame, and is operable to move the slider-assembly forcefully in the said out-and-back mode; and (j) the coupler-assembly is so structured that, when the contact-surfaces are forcefully driven together, the bucket becomes proportionately more forcefully and more rigidly engaged with the arm-end;

wherein the coupler-assembly is so structured, the bucket-lug being assembled to the pivot-pin, that:

(a) the bucket-lug, and a cheek-piece that is rigidly integrated into the arm-end frame, are of such related shape as to form, together, a wedge engagement; and (b) the wedge engagement becomes tighter and more rigid when the arm-end is forced to rotate relative to the bucket about the pivot-pin.

13. The coupler-assembly as claimed in 12, wherein the coupler-assembly is so structured that, when the contact faces are driven together, the arm-end frame is driven to rotate relative to the bucket-lug, about the arm-end pivot-pin, thereby to make the engagement between the bucket and the arm-end tighter and more rigid.

* * * * *